US006342017B1

(12) United States Patent
Kockelman

(10) Patent No.: US 6,342,017 B1
(45) Date of Patent: Jan. 29, 2002

(54) AMUSEMENT RIDE WITH ENHANCED RIDE CONTROL

(75) Inventor: Peter T. Kockelman, Mountain View, CA (US)

(73) Assignee: Gravity Works, Inc., Mountain View, CA (US)

( * ) Notice: Subject to any disclaimer, the term of this patent is extended or adjusted under 35 U.S.C. 154(b) by 0 days.

(21) Appl. No.: 09/708,190

(22) Filed: Nov. 7, 2000

Related U.S. Application Data

(60) Provisional application No. 60/164,053, filed on Nov. 8, 1999.

(51) Int. Cl.[7] ..... A63G 31/00
(52) U.S. Cl. ..... 472/131; 472/49
(58) Field of Search ..... 472/43, 49, 50, 472/131; 434/30, 34, 54, 55; 104/53, 77, 78, 86

(56) References Cited

U.S. PATENT DOCUMENTS

| | | | | | |
|---|---|---|---|---|---|
| 3,286,373 | A | * | 11/1966 | Mangieri | 434/30 |
| 4,580,982 | A | * | 4/1986 | Ruppert | 434/30 |
| 5,267,906 | A | | 12/1993 | Kitchen et al. | |
| 5,893,802 | A | * | 4/1999 | Bohme | 472/131 |
| 5,911,634 | A | * | 6/1999 | Nidata et al. | 472/59 |
| 6,083,111 | A | * | 7/2000 | Moser et al. | 472/50 |

* cited by examiner

*Primary Examiner*—Kien T. Nguyen
(74) *Attorney, Agent, or Firm*—Meyer Intellectual Property Law; Virginia H. Meyer, Esq.; Mark J. Spolyar, Esq.

(57) ABSTRACT

Amusement ride that allows for enhanced control of the ride path and, thus, the riders' experience. In one embodiment, the ride allows for manual control of the acceleration, speed and direction of the carrier into which at least one rider is secured. In one embodiment, the ride also allows for selection of one from a plurality of pre-programmed ride paths.

11 Claims, 2 Drawing Sheets

AMUSEMENT RIDE WITH ENHANCED RIDE CONTROL

This application claims benefit to Provisional Application No. 60/164053 filed Nov. 8, 1999.

FIELD OF THE INVENTION

The present invention relates to amusement rides and, more particularly, to an amusement ride allowing for enhanced control of the rider's experience.

BACKGROUND OF THE INVENTION

Myriad amusement rides are known in the art for propelling riders vertically and/or horizontally. For example, U.S. Pat. No. 5,421,783 discloses a human slingshot amusement ride, wherein elastic cords propel a carrier between two elongated towers. Another prior art amusement ride designed to approximate the feeling of free fall includes a carrier movably mounted in vertical tower. When the carrier reaches the top, it is released in a free fall guided by the track. In another example, U.S. Pat. No. 5,267,906 discloses a swing-type amusement ride wherein a rider swings from a cord connected to a tower. To initiate the ride, the rider is lifted in the air and released to swing like a pendulum. While the prior art rides fulfill their respective objectives, once the carrier is released, they do not allow for precise, real-time control over the action of the ride and, therefore, the rider's experience.

SUMMARY OF THE INVENTION

The present invention provides an amusement ride that allows for enhanced control of the ride path and, thus, the riders' experience. In one embodiment, the present invention allows for manual control of the acceleration, speed and direction of the carrier into which at least one rider is secured. The amusement ride of the present invention comprises a track, a carrier engaging the track and moveable along the track, a control system, and a propulsion mechanism operably connected to the control system. According to the invention, the propulsion mechanism is also operably connected to the carrier to displace the carrier along the track in response to control signals from the control system.

In one embodiment, riders sit in and are strapped into specially designed chairs attached to the carrier. In one embodiment, the present invention allows a pair of riders to move up or down a track that can either be vertical, horizontal, or inclined at some angle. In one embodiment, a control device (such as a joystick similar to that used for a video game) is positioned between each pair of riders. In this embodiment, the joystick can be pushed or pulled by one of the pair of riders to control movement of the carrier.

In one embodiment, the ride's motion is controlled by one of the two riders. In another embodiment, the ride operator controls the ride's motion. In one embodiment, the control system includes a joystick. Other suitable controls include buttons, dials and the like. In one embodiment, the joystick that controls the ride's motion sends signals to the control system on the ground via a cable that is attached to the chair and runs down to the ground. At the ground is a cable reel that takes up the slack or pays out the amount of cable that is needed. In another embodiment, the joystick or control interface communicates wirelessly with the control system.

According to one embodiment, the carrier housing the rider(s) is lifted into the air or pulled back down by wires or cables that are pulled in and released by a propulsion mechanism. In one embodiment, the propulsion mechanism comprises a hydraulic ram and a propulsion magnification system including a block and tackle system. In one embodiment, the wires wind around numerous sheaves in such a way so that if the hydraulic ram extends by 10 feet then the chair is pulled 120 feet into the air. This system is classified as a 12:1 block and tackle system. The speed of the chair then is also 12 times the speed of the ram. In one embodiment, a pneumatic ram is substituted for the hydraulic ram. In another embodiment, the propulsion mechanism comprises a high-speed electric winch operably connected to a control system, instead of a ram and propulsion magnification system.

DESCRIPTION OF PREFERRED EMBODIMENT (S)

Figure 1:
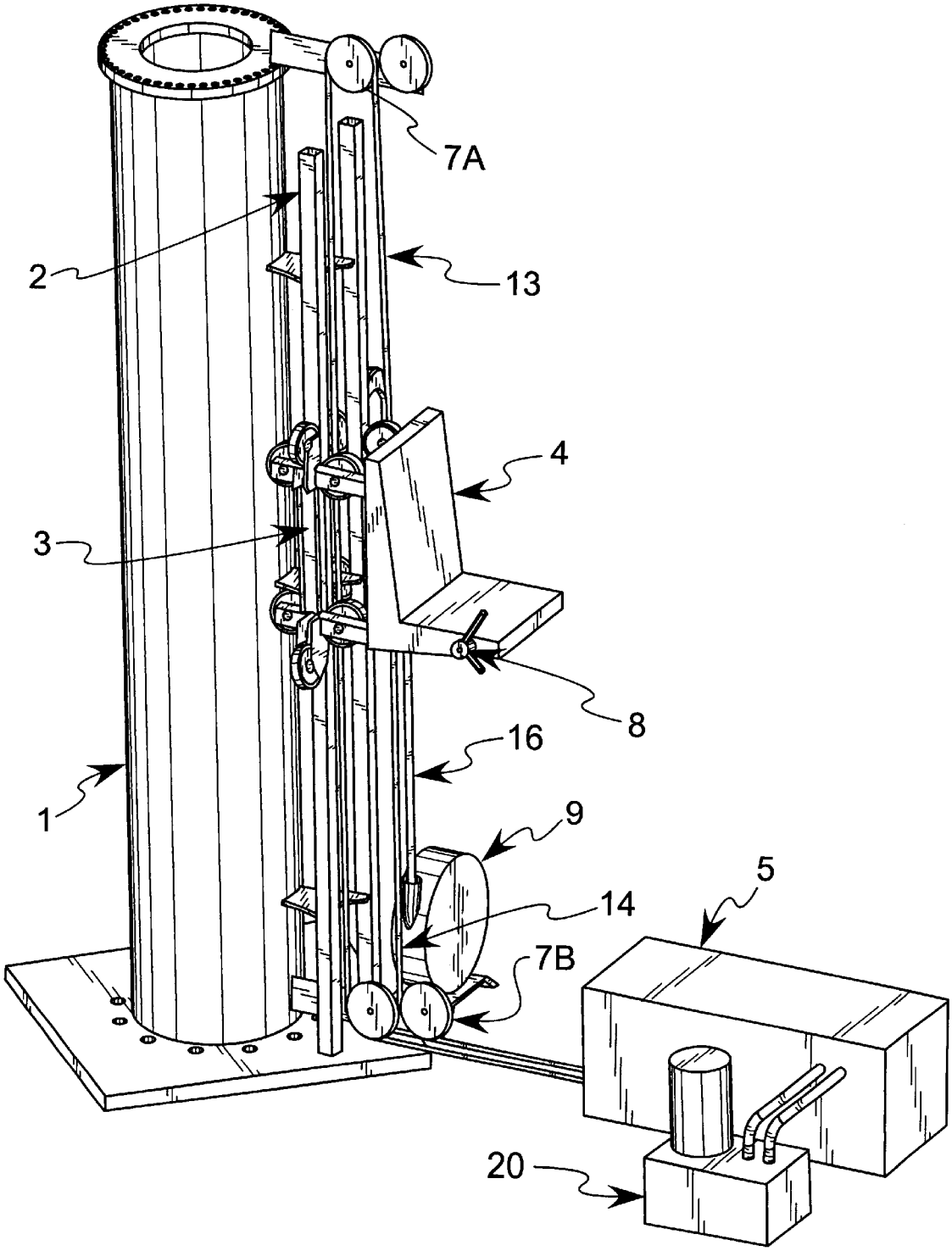
FIG. 1 is a perspective view of the amusement ride according to one embodiment of the present invention.
Figure 2:
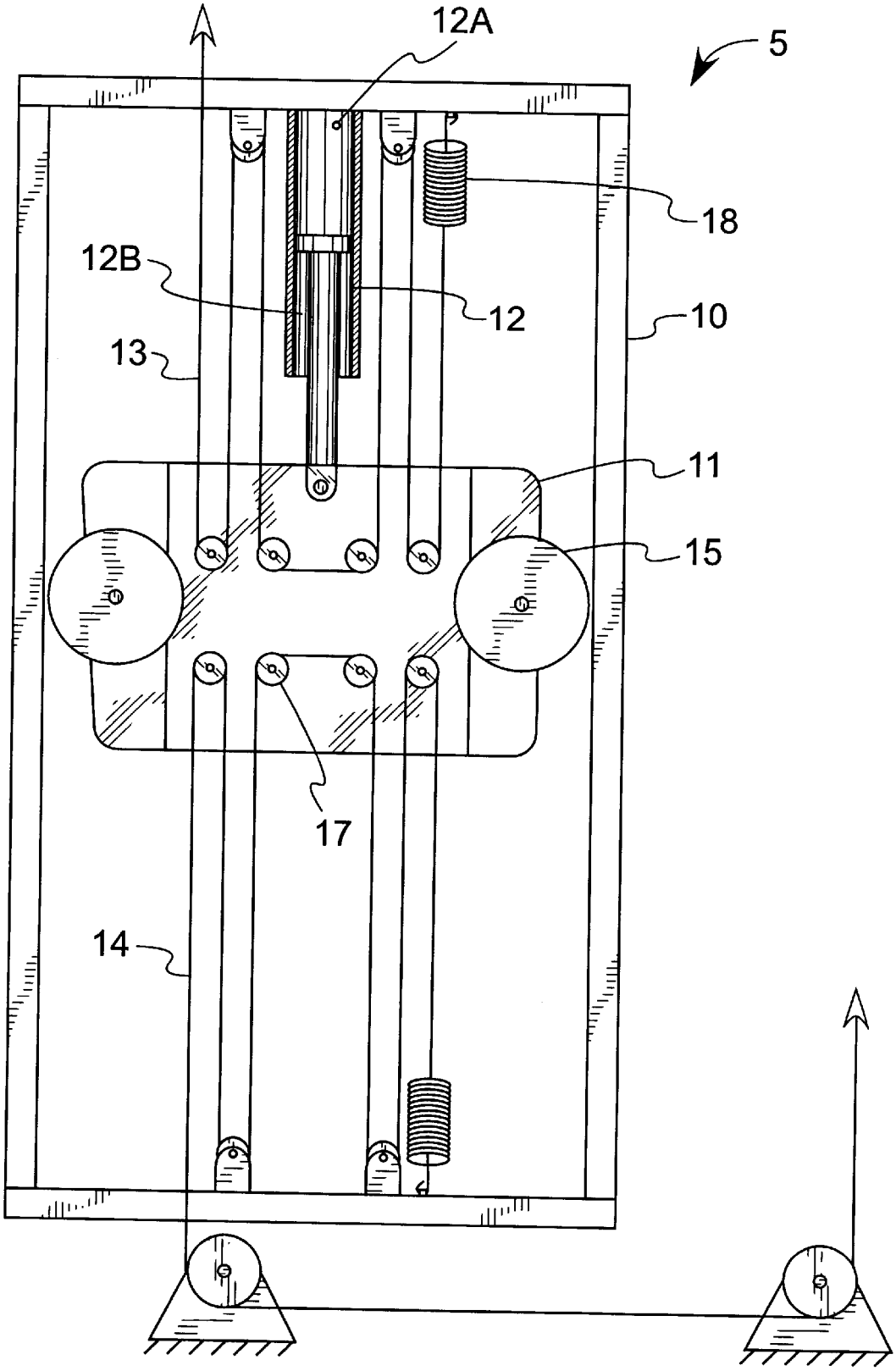
FIG. 2 is a section plan view a propulsion mechanism according to one embodiment of the present invention.

FIGS. 1 and 2 show one embodiment of the amusement ride constructed in accordance with the principles of the present invention. As FIG. 1 shows, one embodiment of the present invention comprises a tower 1 including a track 2 thereon, a carrier 4 having a slider 3 engaging track 2 and at least one chair dimensioned to seat and support a rider, a propulsion mechanism, and a control system. Although not shown, tower 1, in one embodiment, is mounted in a base, such as a large concrete slab or steel frame. In one embodiment, tower 1 comprises a large-diameter (e.g., 30 inches) steel tube obviating the need for guy wires or other support members. Slider 3 engages track 2 and allows carrier 4 to slide therein. In one embodiment, slider 3, includes bogeys (i.e., the wheel assemblies commonly found in roller coaster cars) that guide and constrain movement of carrier 4 in track 2.

The control system controls the ride path of carrier 4 by operating the propulsion mechanism. In one embodiment, the control system allows the rider(s) or ride operator to manually control the ride path. In another embodiment, the control system allows the rider(s) or ride operator to select from a plurality of pre-programmed ride paths. In another embodiment, the control system allows the rider(s) or ride operator the option of manual control or selection of a pre-programmed ride path. In one embodiment, the control system includes a microcomputer or programmable logic controller operably connected to a user interface device, such as a joystick 8 or a control panel. In the embodiment shown, the control system receives control signals via control cable 16, generated during manipulation of joystick 8, and transmits corresponding signals to the propulsion mechanism. In one embodiment, pulling harder on the joystick results in faster upwards motion in the vertical direction, while pushing quickly on the joystick results in faster downward motion. In one embodiment, pushing quickly on the joystick when the carrier is moving rapidly upward result in negative G's (a rider being lifted off his seat) as the carrier is propelled back toward the ground.

As discussed above, in one embodiment, the control system allows the ride operator or the rider(s) to select pre-programmed ride paths. In one embodiment, the control system includes a user interface (such as a panel with buttons corresponding to different pre-programmed ride paths) operably connected to a computing device storing the pre-programmed ride paths. In one embodiment, the microcomputer or programmable logic circuit stores pre-programmed ride paths. Once the ride path has been selected, the microcomputer or programmable logic circuit, in one embodiment, loads the selected ride path into memory and transmits corresponding control signals to the propulsion mechanism to effect movement of the carrier according to the pre-programmed path.

The propulsion mechanism of the embodiment shown in FIGS. 1 and 2 includes hydraulic powerplant assembly 20 and propulsion magnification system 5. In one embodiment, after a ride operator initiates the start of a ride, one of the riders in carrier 4 manipulates joystick 8 sending signals through control cable 16 to the remainder of the control system that operates hydraulic powerplant assembly 20. In one embodiment, control cable 16 connects to a microcomputer or programmable logic circuit that operates hydraulic power plant assembly 20. In one embodiment, the riders can control the direction, acceleration, and speed of carrier 4 with joystick 8. In one embodiment, control cable 16 is stored on cable reel 9. Cable reel 9 is responsible for keeping control cable 16 in constant tension so slack does not form in control cable 16 as carrier 4 moves along track 2. In another embodiment, communication of control signals between joystick 8 and the remainder of the control system operating on hydraulic powerplant 20 is wireless, thereby obviating the need for cable 16 and cable reel 9.

The hydraulic powerplant assembly 20 supplies hydraulic oil under pressure to effect displacement of hydraulic ram 12 of propulsion magnification system 5. In one embodiment, propulsion magnification system 5 consists of a rigid frame 10 to which hydraulic ram 12 is attached. The rod end 12B of hydraulic ram 12 is attached to main block 11, which is constrained to move back and forth within rigid frame 10. Main block 11 is guided within the rigid frame 10 by guide wheels 15.

Hydraulic powerplant assembly 20 provides fluid under pressure to extend and retract hydraulic ram 12 in a conventional manner. Hydraulic powerplant assembly 20 and ram 12 include the proper valves (not shown) to effect extension and retraction of the ram 12. When hydraulic oil under pressure is directed from the hydraulic powerplant assembly to the piston end 12A of hydraulic ram 12, hydraulic ram 12 is forced to extend, pushing the main block 11 away from ram 12. In the embodiment shown, lifting cable 13 and lowering cable 14 attach to slider 3 of carrier 4. Lifting cable 13 is routed from slider 3 up to top sheave 7A and back down to propulsion magnification system 5 where it weaves back an forth between main block 11 and the top of rigid frame 10. As FIG. 2 illustrates, a series of sheaves or pulleys 17 attached to both main block 11 and rigid frame 10 guide, support, and redirect lifting cable 13. In one embodiment, the other end of lifting cable 13 is attached to the top of the rigid frame 10 via an extension spring 18. In another embodiment, the other end of lifting cable 13 is directly attached to the top of rigid frame 10.

Lowering cable 14 is reeved similarly to that of lifting cable 13. In the embodiment shown, lowering cable 14 attaches to slider 3 of carrier 4, extends through bottom sheaves or pulleys 7B and terminates at the propulsion mechanism. In one embodiment, lowering cable 14, as with lifting cable 13, is supported and redirected, within rigid frame 10 by sheaves or pulleys 17 between main block 11 and rigid frame 10.

When hydraulic fluid under pressure is directed from the hydraulic powerplant assembly 20 to the rod end 12B of the hydraulic ram 12, the hydraulic ram 12 is forced to retract pulling the main block 11 up. This action raises the end of lowering cable 14 attached to main block 11 and ultimately routed through the bottom sheave 7, to pull slider 3 and carrier 4 down. Lowering of carrier 4 tensions lifting cable 13 and takes up the slack caused by upward displacement of main block 11. Conversely, when hydraulic power plant assembly 20 direct fluid under pressure to the piston end 12A of hydraulic ram 12, main block 11 moves downwardly, thereby causing lifting cable 13 to pull carrier 4 up track 2. As above, lifting of carrier 4 tensions lowering cable 14 and takes up the slack caused by downward displacement of main block 11. In the embodiment shown, slider 3 will be displaced a distance approximately 6 times the distance main block 11 moves. This distance depends upon how many times the lifting cable 13 and/or lowering cable 14 is/are reeved back and forth between main block 11 and rigid frame 10 (in FIG. 2 it is reeved 6 times). If lifting cable 13 is reeved 12 times, then slider 3 will move about 12 feet for every 1 foot of movement in main block 11. Of course, the block and tackle ratios employed in the embodiments described herein are not required by any constraint and depend on the dimensions and desired characteristics of the ride. In another embodiment, the propulsion mechanism comprises a high speed winch that pulls in and pays out lifting cable 13 or lowering cable 14 to effect movement of carrier 4. In one such embodiment, lifting cable 13 and lowering cable 14 are joined and operably connected to the high speed winch.

The foregoing is considered as illustrative only of certain embodiments and the principles of the present invention. Since numerous modifications and changes will readily occur to those skilled in the art, the invention is not limited to the exact construction and operation shown and described. Therefore, it is intended that all suitable modifications and equivalents which may be resorted to fall within the scope of the invention. Accordingly, all equivalent relationships to those illustrated in the drawings and described in the specification are intended to be encompassed by the present invention.

What is claimed is:

1. An amusement ride comprising a track, a carrier formed and dimensioned to safely support at least one human therein; the carrier movably mounted in the track, a propulsion mechanism, a control system communicably connected to the propulsion system, the control system transmitting control signals directing movement of the propulsion system, a first pulley proximally located at a first end of the track, a second pulley proximally located at a second end of the track, a first cable attached at one end to the carrier, supported by the first pulley, and attached at the other end to the propulsion system, a second cable attached at one end to the carrier, supported by the second pulley, and attached at the other end to the propulsion system, the propulsion mechanism, in response to control signals from the control system, pulling in either the first cable or the second cable to effect corresponding movement of the carrier in the track.

2. The amusement ride of claim 1 wherein the propulsion mechanism comprises an electric high-speed winch.

3. The amusement ride of claim 1 wherein the track extends vertically in the air.

4. The amusement ride of claim 1 wherein the track extends horizontally.

5. The amusement ride of claim 1 wherein the propulsion mechanism comprises a displacement mechanism and means, attached to the displacement mechanism, for magnifying the displacement output of said displacement mechanism.

6. The amusement ride of claim 5 wherein the displacement mechanism comprises a hydraulic ram.

7. The amusement ride of claim 5 wherein the displacement mechanism comprises a pneumatic ram.

8. The amusement ride of claim 1 wherein the control system comprises a joystick.

9. The amusement ride of claim 8 wherein the joystick is attached to the carrier to allow a rider supported therein to control the joystick.

10. The amusement ride of claim 1 wherein the control system allows for selection of at least one pre-programmed ride path.

11. The amusement ride of claim 1 wherein the control system stores at least one pre-programmed ride path; and wherein the control system transmits control signals to the propulsion system according to the pre-programmed ride path.

* * * * *